US006231481B1

(12) United States Patent
Brock

(10) Patent No.: US 6,231,481 B1
(45) Date of Patent: May 15, 2001

(54) PHYSICAL ACTIVITY MEASURING METHOD AND APPARATUS

(76) Inventor: Kurtis Barkley Brock, 19352 Bluefish La., Unit 101, Huntington Beach, CA (US) 92648

( * ) Notice: Subject to any disclaimer, the term of this patent is extended or adjusted under 35 U.S.C. 154(b) by 0 days.

(21) Appl. No.: 09/436,065

(22) Filed: Nov. 8, 1999

Related U.S. Application Data

(60) Provisional application No. 60/107,906, filed on Nov. 10, 1998.

(51) Int. Cl.[7] ..... A63B 21/00
(52) U.S. Cl. ..... 482/8; 482/9
(58) Field of Search ..... 482/1, 8, 9, 106, 482/900–902

(56) References Cited

U.S. PATENT DOCUMENTS 5,919,115 * 7/1999 Horowitz et al. ..... 482/6

OTHER PUBLICATIONS

PTI, Cad Tex,, pp. 1–13, Nov. 1987.*

* cited by examiner

*Primary Examiner*—Glenn E. Richman
(74) *Attorney, Agent, or Firm*—Fuldwider Patton Lee & Utecht, LLP

(57) ABSTRACT

An apparatus for measuring the power generated by a person who is performing physical activity and displaying a readout of such measurement to the user. The apparatus senses and measures the motion of a mass that the person is moving and/or working against, derives position, velocity, and acceleration data and calculates power. The person thereby gains benefit of such information in real time.

11 Claims, 7 Drawing Sheets

PHYSICAL ACTIVITY MEASURING METHOD AND APPARATUS

This application claims the benefit of Provisional Application 60/107906 filed Nov. 10, 1998.

BACKGROUND OF THE INVENTION

The present invention generally relates to the measurement of the power generated by a person who is performing a physical activity. More specifically, the present invention pertains to the detection, measurement and display, in real time, of the peak power generated by, for example, an athlete or a physical therapy patient.

Many physical training professionals favor training regimens that emphasize quick, explosive movements that maximize the recruitment of fast twitch muscle fiber, with either weight training machines or free weights. It is believed that such training would be even more effective it the athlete or patient were to be instantaneously aware of his or her peak power output.

It is conceivable that a process that directly measures a person's neuromuscular activity could be employed to generate such information, but the rather esoteric and expensive medical laboratory devices that would be needed are cost prohibitive. Moreover, the complexity of such systems and the need for a trained technician to operate such systems renders such approach impractical for use in a weight training gym environment.

An alternative approach involves the detection and measurement of the motion that is imparted to a mass by an individual and then calculating the peak power that is required to achieve such motion. Use of accelerometers that are attached directly to free weights or machine weight stacks may be employed to generate such data, but such accelerometers are expensive, fragile, and susceptible to offset errors that can quickly accumulate to yield intolerable inaccuracies.

An improved power measuring apparatus is therefore needed that is capable of providing a real time measurement of the power generated by a person. Such apparatus must be inexpensive to manufacture, must be simple to use, must provide accurate information, and must be sufficiently durable for use in a gym-type environment.

SUMMARY OF THE INVENTION

Briefly, and in general terms, the present invention provides a new and improved apparatus for measuring and displaying power generated by a person who is performing a physical activity. More specifically, the apparatus senses and measures the motion of a mass such person is moving and/or working against, by deriving position, velocity, acceleration, calculating power, and displaying one or more such values by means of a display screen. The present invention may be incorporated in any number of physical training devices including free weights and universal gym equipment.

The apparatus will be utilized in situations where the power generated by a person performing physical activity is desired to be known. Such situations may include, but are not limited to, athletic weight training, sports medicine, body building, power lifting training, personal physical evaluation, physical rehabilitation, and personal fitness exercise.

In general terms, the apparatus of the present invention consists of a sensor/transducer that generates a signal as a function of the position of a weight being lifted by the user. Such signal is then transmitted to a computer where the power needed to achieve a sensed change in position is calculated. The calculated value is then displayed to the user.

Examples of a sensor/transducers adaptable to the present invention include but are not limited to cable extension potentiometers, accelerometers, linear velocity transducers (LVT), linear variable differential transformers (LVDT), ultrasonic, microwave, infrared, laser, magnetic, video and/or radio frequency position, velocity, and/or acceleration sensor/transducers. The output may be in the form of analog and/or digital data.

Examples of the computer used to convert the sensor/transducer signal into meaningful information may include, but are not limited to, dedicated single purpose digital computers, general multipurpose digital computers, operational amplifier-based analog computers, hybrid analog/digital computational circuits, and/or digital signal processors (DSP). The methodology for deriving and/or computing position, velocity, acceleration, and power data may consist of, but is not limited to, analog differentiation, and/or integration circuitry, and/or computational methods including, but not limited to, digital signal processing, Fourier transform analysis, wavelet theory analysis, least squares, and/or other curve fitting analyses, and/or frequency spectrum analysis.

Examples of the display device for communicating the calculated information to the user include, but are not limited to, cathode ray tube (CRT), liquid crystal display (LCD), light emitting diode (LED), oscillograph, printer, and/or video projection devices. The display format utilized by such display device may include, but is not limited to, numerals, bar graphs, oscillographic data, and/or audio output including signal tones and/or recorded voice.

More particularly, the apparatus of the present invention may take the form of a cable extension potentiometer that is physically attached to a free weight or a universal weight machine. The potentiometer sends an analog voltage signal to a set of operational amplifiers that function to break down the signal into position, velocity, and acceleration data in the form of analog voltage. The analog voltage is then digitized with a 12 bit analog to digital converter. The digital computer then calculates power which is then be related to the user along with other relevant information such as position, velocity, and acceleration.

These and other features and advantages of the present invention will become apparent from the following detailed description of a preferred embodiment which, taken in conjunction with the accompanying drawings, illustrates by way of example the principles of the invention.

DETAILED DESCRIPTION OF THE INVENTION

The figures generally illustrate preferred embodiments of the present invention. The apparatus interfaces with weights being manipulated by a user and calculates the power being generated. Such feedback can assist a user in maximizing or optimizing his efforts.

Figure 1:
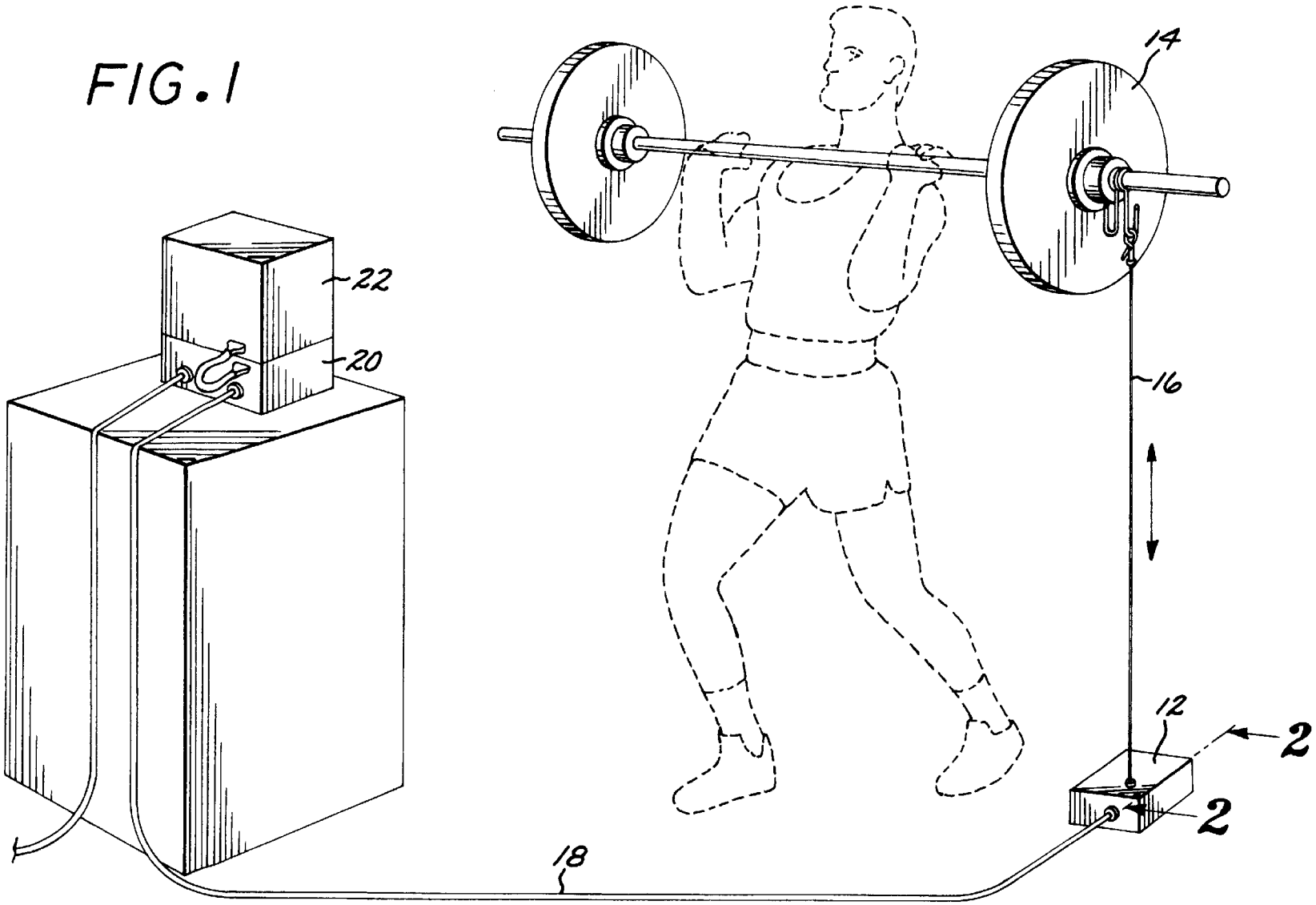
FIG. 1 illustrates the various components of a preferred embodiment of the present invention.

FIG. 1 illustrates the general layout of a preferred embodiment of the present invention. In the example illustrated, the apparatus is associated with a free weight that the user is lifting. The apparatus includes a sensor 12 that senses the position of the weight 14 and generates corresponding electrical signals. A physical interconnection between the weight and the sensor may take the form of a cable 16 that is hooked to the weight. The signals generated by the sensor are transmitted via signal cable 18 to a computer 20 that calculates various parameters of interest. A display screen 22 presents the relevant information to the user.

Figure 2:
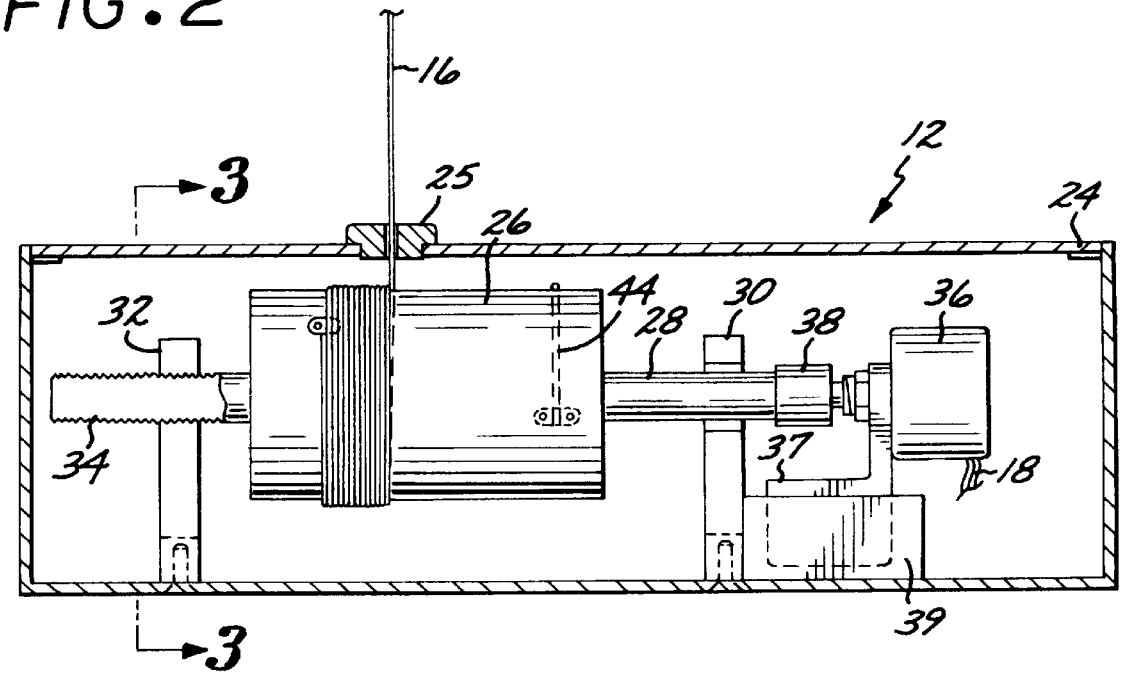
FIG. 2 is an enlarged cross-sectional view taken along lines 2—2 of FIG. 1.

FIG. 2 is a cross-sectional view of the sensor 12 shown in FIG. 1. The cable 16 extends into a housing 24 through eyelet 25 where it is wound about a receiving spool 26. The spool is fitted about an axle 28 which in turn is rotatably supported by support elements 30 and 32. The distal end of the axle has an external thread 34 formed thereon which cooperates with an internal thread formed within support element 32 to axially shift the drum slightly as it is rotated. At its proximal end, the axle is coupled to a transducer in the form of a potentiometer 36. A fixed vane 37 extends from the potentiometer that is slidably received in a grooved block 39 so as to prevent any rotation of the potentiometer yet allow for the slight axial displacement induced by rotation of the threaded axle in the threaded support. Alternatively, the coupling 38 may be configured to accommodate such axial movement. The potentiometer generates an analog signal as a function of its rotational position.

Figure 3:
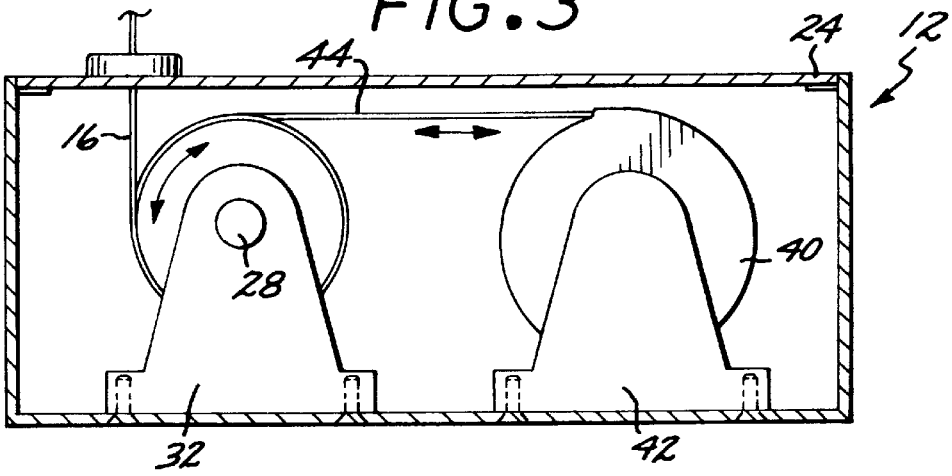
FIG. 3 is a cross-sectional view taken along lines 3—3 of FIG. 2.

FIG. 3 is another cross-sectional view showing the internal configuration of the sensor 12 and more particularly illustrates the position of a tension reel 40 by which a slight amount of tension is maintained on cable 16 to cause it to be properly wound onto the receiving spool 26 as the weight 14 is lowered. The tension reel is rotatably supported by a pair of support elements 42 and is operatively interconnected with the receiving spool by a tension cable 44. The tension reel is spring loaded so as to provide sufficient tension to ensure the proper paying out and take-up of cable 16 yet not interfere with the manipulation of the weight 14 in any way.

Figure 4:
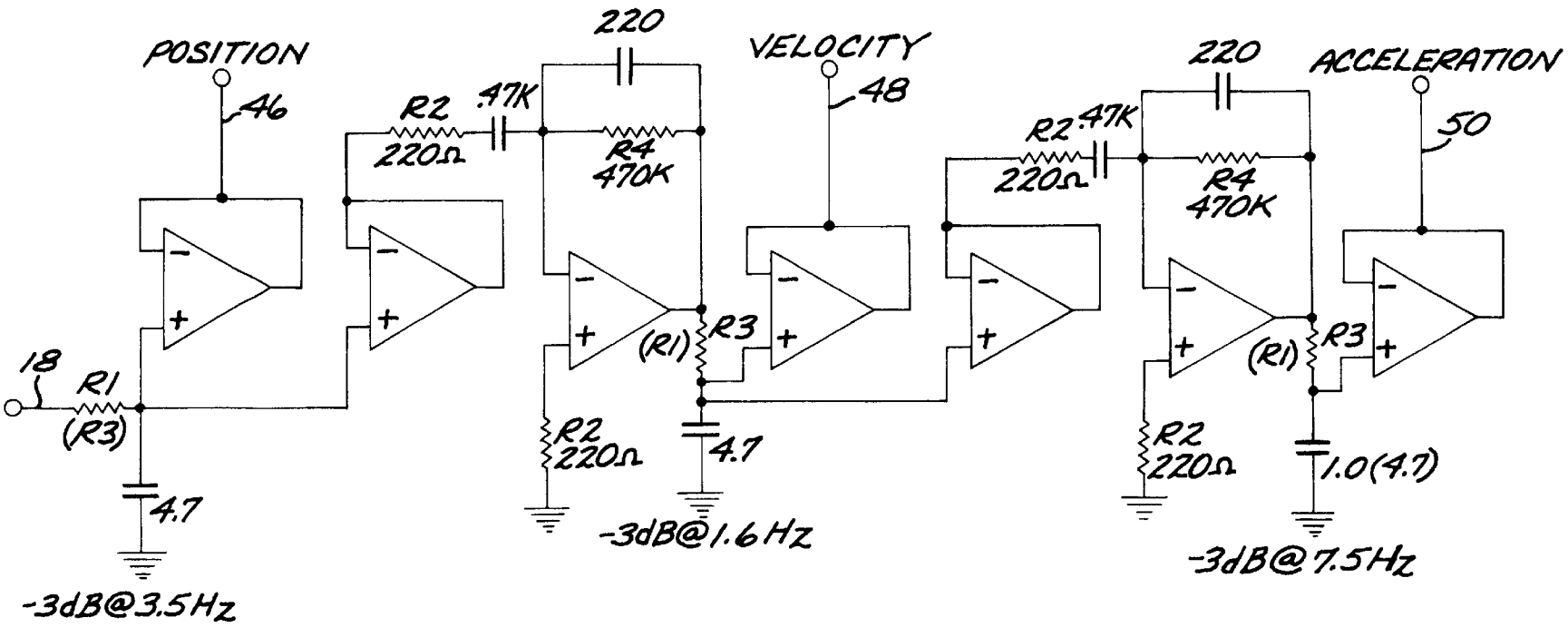
FIG. 4 is a circuit diagram showing a preferred manner of processing the raw signal generated by the sensor.
Figure 5:
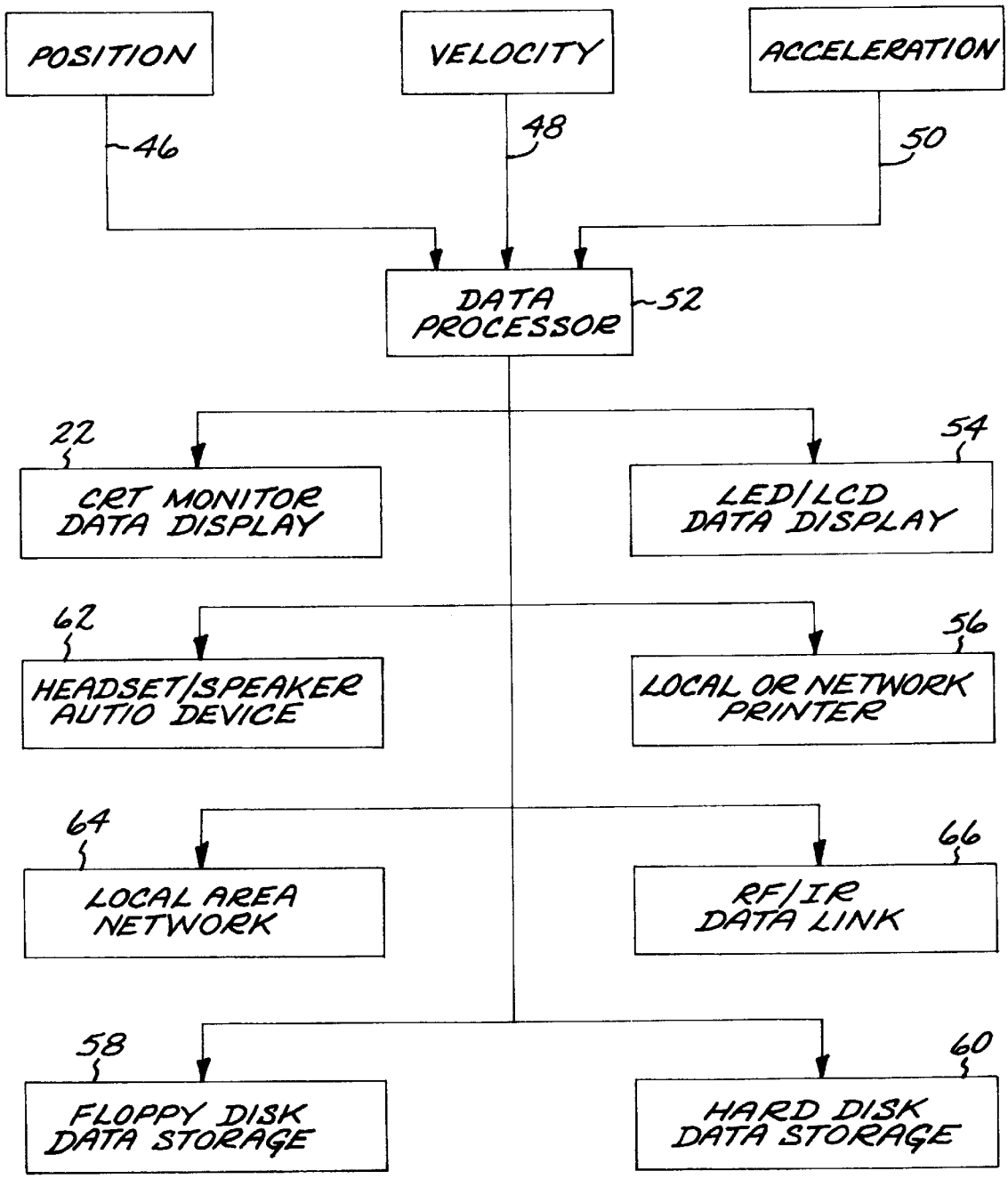
FIG. 5 is a chart illustrating the data handling capability of the computer of the present invention.

FIG. 4 is a basic circuit diagram illustrating how the output from potentiometer 36 may be processed within the computer 20 to provide an analog signal corresponding to the position 46, velocity 48, and acceleration 50 of the weight 14. The diagram shows the use of seven operational amplifiers to differentiate position, velocity, and acceleration data from the voltage signal received via conduit 18. FIG. 5 illustrates the flow of the analog data into the data processor 52 where it is digitized by a 12 bit analog to digital converter. The resulting data is then used by the computer in conjunction with preprogrammed data to calculate power by the formula P=M(1+A)(V) wherein M=the mass being lifted, A=acceleration of the mass in g's and V=velocity.

As is illustrated in FIG. 5, the computer 20 may be configured to provide versatility beyond merely displaying the calculated power on the display screen 22. Information can be displayed on a CRT monitor 22 or an alphanumeric display 54 and/or any such information can be printed 56 or stored on either a floppy disk 58 or hard disk 60. The storage disks may also be accessed to retrieve prerecorded data or an audio/visual record. Alternatively, an audio signal may be conducted to a speaker via port 62. The system can additionally be networked through port 64 and an RF/IR data link 66 is provided for alternative data transmission capability.

Figure 6:
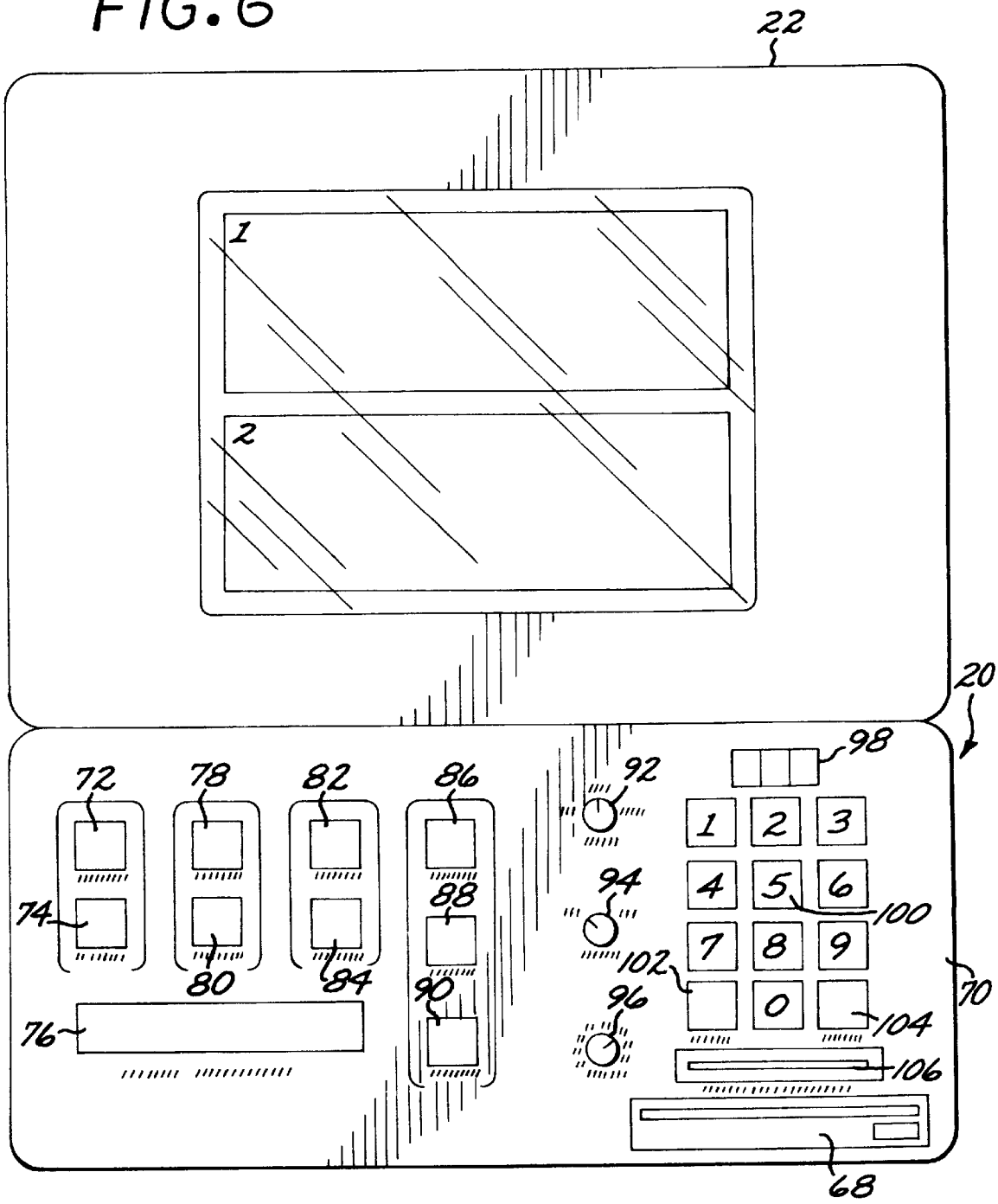
FIG. 6 is an elevation of the computer and display screen of the present invention.

FIG. 6 illustrates a preferred embodiment of the control panel for the computer 20 shown in FIG. 1. Such illustration demonstrates the capabilities of a computer that may advantageously be employed in practicing the present invention. The control panel includes a plurality of pushbuttons, displays, a keypad, card readers and access to a floppy disk drive, which greatly enhances the overall utility of the system in a user friendly manner.

Operations Manual: Pressing button 72 causes sound and video to be heard and displayed on the computer monitor 22 that explains the operation of the system. Topics include (A) Setting up the system and the position transducer, (B) Function of each item on the front and back panels, (C) Proper maintenance and storage of the apparatus. This video is stored on the hard disk drive 60 in a compression format. This button is disabled if a numeric-only output display is being used instead of the computer monitor.

Figure 7:
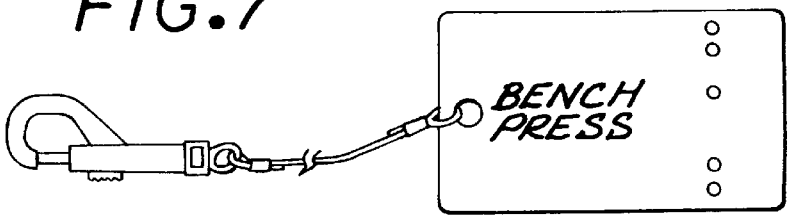
FIG. 7 illustrates the preferred format of a data card employed in the operation of the system of the present invention.

Training Manual: Pressing button 74 causes sound and video to be heard and displayed on the computer monitor 22, that explains the proper method to perform a particular weight lifting exercise. The exercise to be demonstrated and explained is chosen by inserting the appropriate Exercise Identification Card, an example of which is illustrated in FIG. 7, into the Exercise ID card Slot 106. This video is stored on the hard disk drive in a compression format. The button is disabled if a numeric-only output display is being used instead of the computer monitor.

System Display Screen: Alphanumeric screen 76 displays pertinent information regarding the status of the computer system's operations. The primary use of this screen however is to display and verify the name of the exercise selected when the Exercise Identification Card is inserted into the Exercise ID Card Slot 106. The display can be LED, LCD or fluorescent screen of one to three rows with eight to 40 characters per row.

Figure 8:
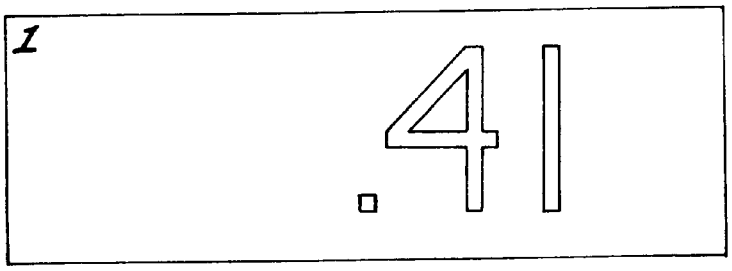
FIG. 8 illustrates a portion of a split screen display showing peak power in a numerical format.
Figure 9:
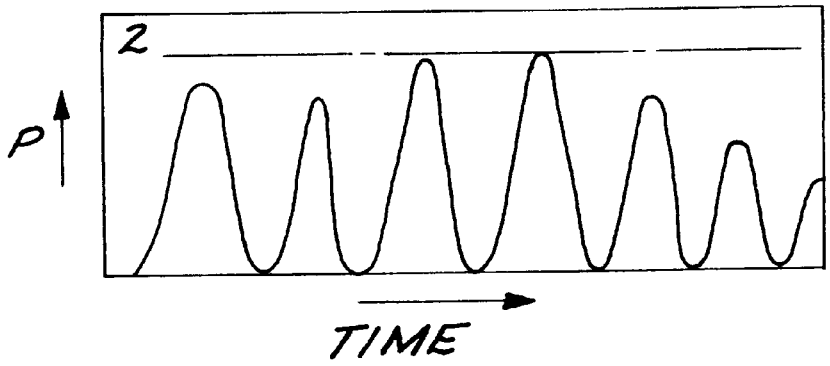
FIG. 9 illustrates a portion of a split screen display showing power generation in an oscillographic format.

Numeral and Power/Time Graph: Pressing button 78 causes a split screen display on the computer monitor 22. The upper half of the screen displays peak power, being generated by the person performing a weight lifting exercise in four digit numeric format. An example of such displayed information is shown in FIG. 8. The lower half of the screen displays power, being generated by the performing a weight lifting exercise in a continuous, real time oscillographic line-graph format. An example of such displayed information is shown in FIG. 9. The Y axis of this graph is relative power being generated, while the X axis of this graph is elapsed time. Only the numeric peak power data, displayed on the upper half of the screen, is available if a numeric-only display is being used instead of the computer monitor.

Figure 10:
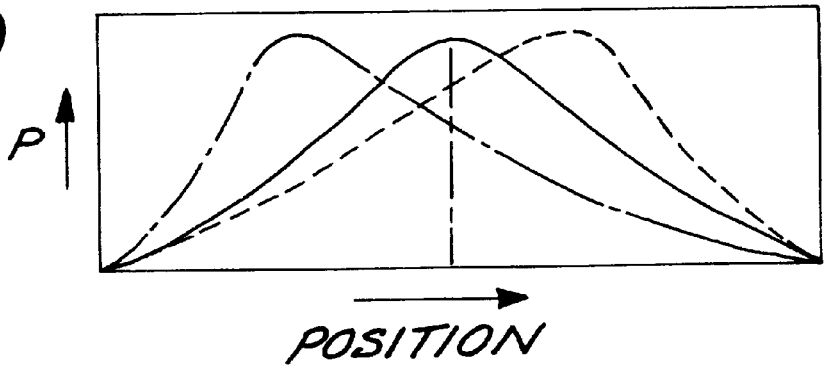
FIG. 10 illustrates a screen showing power output in a graphic format.

Power/Position Graph: Pressing button 80 causes an X–Y graph to be displayed on the computer monitor. An example of such display is shown in FIG. 10. The Y axis of this graph is relative power being generated, while the X axis of this graph is the vertical position of the weight being lifted by the person performing a weight lifting exercise. This graph reveals the power being generated, by the person, over his/her range of motion. The X and Y axes can be switched to display vertical position of the weight on the Y axis, while relative power output is displayed on the X axis. This button is disabled if a numeric-only output display is being used instead of the computer monitor.

Numeral Reset: Pressing button 82 causes the numeric peak power value, of the computer monitor and/or the numeric-only display, to be set to zero.

Graph Reset: Pressing button 84 causes a blank screen in both the Power/Time Graph and the Power/Position Graph displays. (The X–Y coordinate lines and associated labels remain intact, but the data lines are erased.) This button is disabled if a numeric-only output display is being used instead of the computer monitor.

History: Pressing button 86 causes a bar chart and/or line graph to be displayed on the computer monitor. The X axis of this chart displays dates in month/day format, while the Y axis displays peak power achieved, by a person, for a particular weight lifting exercise on the date shown on the X axis. The data required to create this chart is obtained from the following sources: (A) Month/day data is obtained by the computer's internal system clock, (B) The particular weight lifting exercise is recognized and obtained by the data encoded on the Exercise Identification Card when inserted into the Exercise ID Card Slot 106, (C) Data regarding historical peak power achieved is obtained from the person's Personal Data Disk that has been inserted into the floppy disk drive 108. This button is disabled if a numeric-only output display is being used instead of the computer monitor.

Pause: Pressing button 88 causes the computer program to suspend processing. Specifically, this stops the progression of the X axis, showing elapsed time in the Power/Time Graph, enabling easier inspection of the graphed data line for analysis purposes. Pressing this button an additional time, causes the computer program to resume processing.

Save: Pressing button 90 causes the current peak power data, generated by the person performing a weight lifting exercise, to be copied to the person's Personal Data Disk that has been inserted into the floppy disk drive 108. Specifically, the person's current peak power, weight lifting exercise being performed, and date are copied to a unique file that is identified by these three data inputs. This file system architecture is necessary to enable creation of a historical performance chart when the History button is pressed 86.

Power Output: Switch 92 allows Horsepower, Foot Pounds Per Second, or Watts to be selected as the unit of measurement of peak power, generated by the person performing a weight lifting exercise, to be shown on the numeric displays. As a reference, one horsepower is equal to 550 foot pounds per second and approximately equal to 746 watts.

Weight: Switch 94 allows Pounds or Kilograms to be selected as the measurement of weight used by the computer, to calculate peak power generated by the person performing a weight lifting exercise. As a reference, one kilogram is approximately equal to 2.2046 pounds.

Graph Gain: Switch 96 allows a scaling factor to be selected for the power data displayed in graphical form. The lower range reduces the height of the displayed data and the upper range increases the height. This in turn, allows the graph to be tailored to individual differences in power-output. For example, a lower gain would be selected for persons generating high levels of peak-power, while a higher gain would be selected for those generating lower levels of peak power.

Weight Selection Display: Three digit display 98 shows the weight selected by the numeric keypad 100. This display is an LED, LCD or fluorescent 7-segment type.

Data Entry: Keypad 100 allows the entering of weight data. The value entered would correspond with the amount of weight being lifted by the person performing an exercise. Shown in the front panel diagram is a 10 key numeric entry pad. However, three 10 position rotary switches may be used to enter the weight data in place of the 10 key entry pad.

Clear: Pressing button 102 causes the weight value shown on the Weight Selection Display 98 to be set to zero. Any changes in the weight being lifted by the person performing an exercise, will result in first clearing the old weight value by pressing this button and second, entering the new weight value with the keypad 100.

Enter: Pressing button 104 causes the weight value, entered via keypad 100 and shown by the display 98, to be entered into system memory. This weight value is one of several parameters necessary for the computer to calculate the power being generated by the person performing a weight lifting exercise.

Exercise ID Card: Inserting an Exercise Identification Card (shown in FIG. 7) into this slot 106 causes the unique code for a particular weight lifting exercise to be entered into system memory. In addition, the name of the exercise will be shown on the System Display Screen 76. Each exercise in a weight lifting facility will have an associated Exercise Identification Card. Identification of the exercise will enable the system computer to: A: Select and display the appropriate training video segment when the Training Manual button 74 is pressed, B: Select the appropriate data files, from a person's Personal Data Disk, to create a history graph when the History button 86 is pressed, C: Along with date information, create appropriate data files, on the person's Personal Data Disk when the Save button 90 is pressed.

Floppy Disk Drive: The disk drive 108 is primarily used to read data from and write data to a person's Personal Data Disk. The Personal Data Disk contains peak power data for each day a person performs particular weight lifting exercises. For example, if a person performs 12 different weight lifting exercises on each of 60 different days, the Personal Data Disk will contain 360 peak power data points (12 exercises×60 days=360). Additionally, this drive is used to update the computer system with new software releases.

Figure 11:
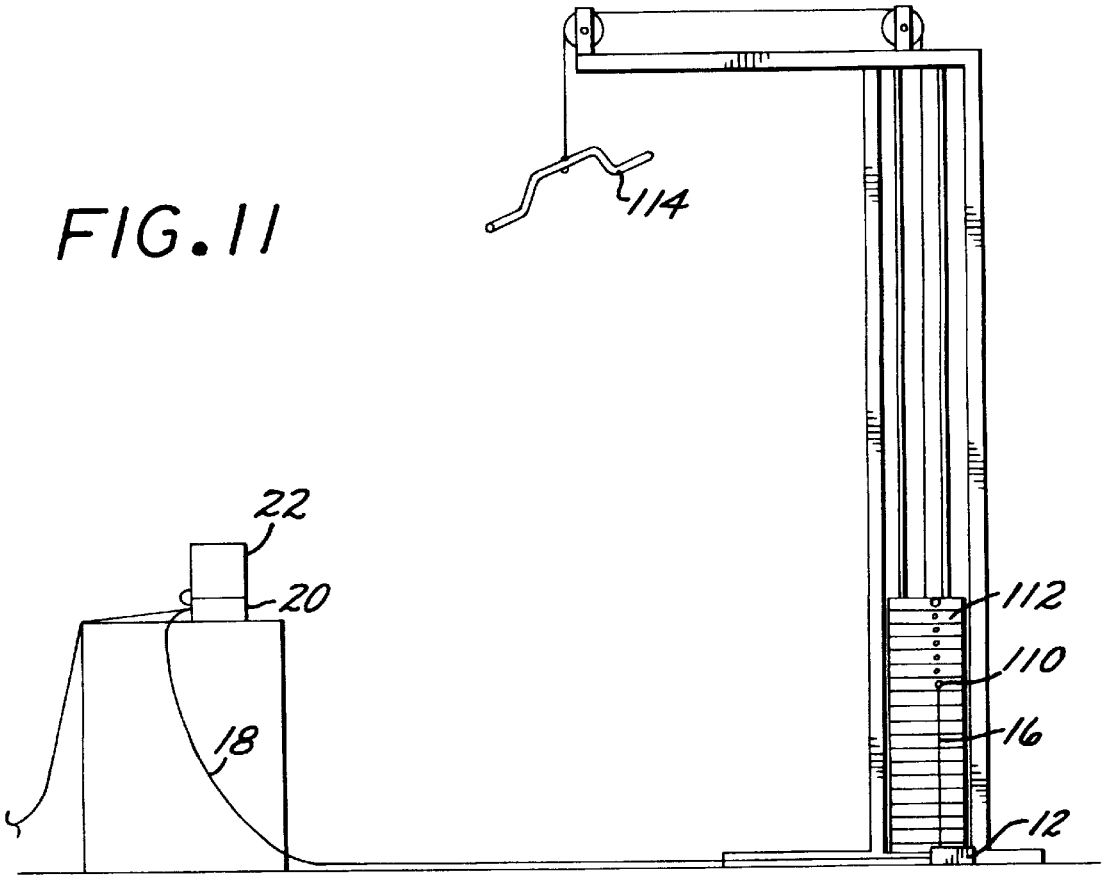
FIG. 11 illustrates an alternative embodiment of the present invention in use on a weight machine.

FIG. 11 illustrates the present invention adapted for use in a commonly used weight machine. The cable 16 extending from sensor 12 is attached to the pin 110 by which the stack of weights 112 to be lifted is engaged. When a user lifts the selected weight by pulling down on handles 114, the cable 16 is pulled out of sensor 12. The position of the weight is thereby sensed by sensor 12 which generates an electrical signal that is transmitted to computer 20 via cable 18. The signal is processed to provide a measure of the power being generated by the user which is displayed to the user on display screen 22.

Figure 12:
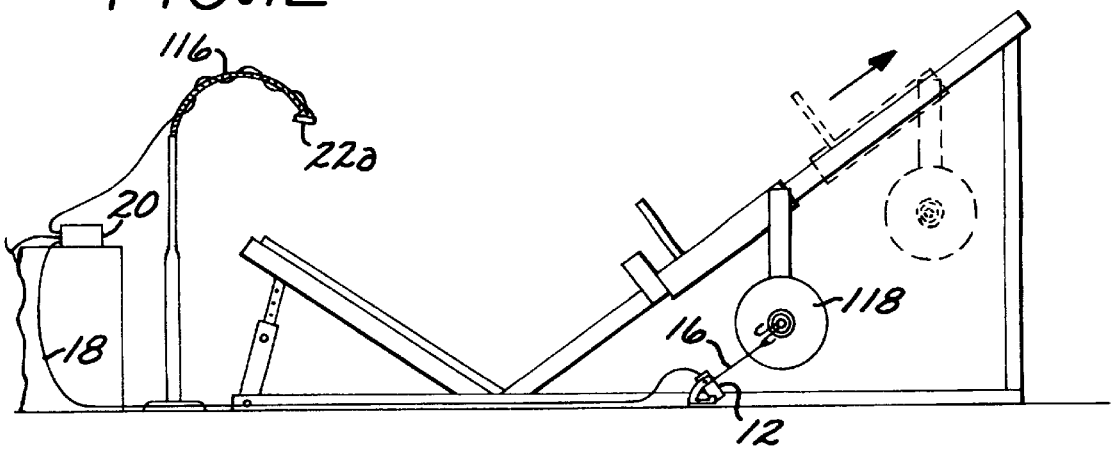
FIG. 12 illustrates another alternative embodiment of the present invention in use on a weight machine.

FIG. 12 illustrates the present invention adapted for use in another commonly used weight machine. The cable extending from the sensor 12 is attached to weight 114 and the signal generated by the sensor is transmitted to the computer

20 via cable 18. This particular embodiment shows a small display screen 22*a* attached to a flexible support arm 116 positioned where the user can readily see it. Such screen may take the form of an alphanumeric display showing only a read out of the power figures.

While a particular form of the present invention has been illustrated and described, it will also be apparent to those skilled in the art that various modifications can be made without departing from the spirit and the scope of the present invention. More particularly, the present invention may be adapted to measure the power generated in manipulating substantially any of the multitude of weight training devices currently in use. Additionally, the sensor need not be limited to a cable extension potentiometer but may take the form of other sensor/transducers including, but not limited to an accelerometer, linear velocity transducer (LVT), linear variable differential transformer (LVDT), ultrasonic, microwave, infrared, laser, magnetic, video and/or radio frequency position, velocity, and/or acceleration sensor/transducers. The output of such devices may be analog or digital. The signal generated by such devices may be transmitted to the computer via wire, optic fiber, or via RF, IR, or microwave transmission or by ultrasonic methods. The computer may take the form of any of a number known devices, not just limited to dedicated single purpose digital computers, but may take the form of general purpose digital computers, operational amplifier-based analog computers, hybrid analog/digital computational circuits, and/or digital processors (DSP). The methodology for deriving and/or computing position, velocity, acceleration, and power data consists of one or more various known technologies including, but not limited to, analog differentiation and/or integration circuitry and/or digital computational methods including, but not limited to, digital signal processing, Fourier transform analysis, wavelet theory analysis, least squares and/or other curve fitting analyses and/or frequency spectrum analysis. The display need not be limited to a CRT device, but may include LCD, LED oscillograph, printer, and/or video projection devices. The display format utilized by such device may include numerals, bar graphs, oscillographic data, seven segment and/or other LEDs and /or audio output including signal tones, and/or recorded voice. Accordingly, it is not intended that the invention be limited except by the appended claims.

What is claimed is:

1. An apparatus for measuring power generated by a person lifting a weight, comprising:

a sensor for generating a signal in response to motion of said weight;

a computer for calculating power required for inducing such motion to said weight;

a display for displaying the calculated power to the person.

2. The apparatus of claim 1, wherein said sensor comprises a cable extension potentiometer wherein a cable physically interconnects said weight and a rotatable spool connected to a potentiometer.

3. The apparatus of claim 2, wherein said potentiometer produces an analog electrical signal.

4. The apparatus of claim 3, wherein said computer processes said signal to determine position, velocity, and acceleration of said weight.

5. The apparatus of claim 4, wherein said computer further employs weight data to calculate power.

6. A method for measuring power generated by a person, comprising the steps of:

providing a weight for said person to lift;

measuring the velocity and acceleration of said weight as it is lifted by said person; and calculating the power required for such weight to be lifted at the measured velocity and acceleration.

7. The method of claim 6, wherein said velocity and acceleration measuring step further comprises the steps of:

sensing the position of said weight; and calculating velocity and acceleration as a function of the change of said sensed position over time.

8. The method of claim 6, further comprising the step of displaying said calculated power to said person in real time.

9. The method of claim 8, wherein peak power is displayed to said person.

10. The method of claim 8, wherein said power is graphically displayed to said person as a function of time.

11. The method of claim 8, wherein said power is graphically displayed to said person as a function of the position of said weight.

* * * * *